US006505657B1

(12) United States Patent
Lawrence

(10) Patent No.: US 6,505,657 B1
(45) Date of Patent: Jan. 14, 2003

(54) CONTAINER LINERS AND METHODS OF LINING CONTAINERS

(75) Inventor: Jon G. Lawrence, Greenfield Center, NY (US)

(73) Assignee: Freedom Packaging Co., Inc., Amsterdam, NY (US)

( * ) Notice: Subject to any disclaimer, the term of this patent is extended or adjusted under 35 U.S.C. 154(b) by 0 days.

(21) Appl. No.: 09/989,575

(22) Filed: Nov. 20, 2001

Related U.S. Application Data

(60) Provisional application No. 60/254,385, filed on Dec. 8, 2000.

(51) Int. Cl.[7] ..... B65B 1/04

(52) U.S. Cl. ..... 141/114; 220/495.03; 383/41; 141/10; 141/313

(58) Field of Search ..... 220/1.6, 495.03, 220/495.04; 383/41, 66, 67; 141/114, 10, 313–317

(56) References Cited

U.S. PATENT DOCUMENTS

| | | | | |
|---|---|---|---|---|
| 4,635,814 A | * | 1/1987 | Jones | 220/495.04 |
| 5,794,670 A | | 8/1998 | LaFleur | 141/314 |
| 5,836,363 A | | 11/1998 | LaFleur | 141/314 |
| 5,851,072 A | | 12/1998 | LaFleur | 383/66 |

* cited by examiner

*Primary Examiner*—Steven O. Douglas
(74) *Attorney, Agent, or Firm*—Heslin Rothenberg Farley & Mesiti P.C.; Jeff Rothenberg, Esq.; Victor A. Cardona, Esq.

(57) ABSTRACT

A liner system for a container is provided which includes a body, a neck, and a valve. The body is adapted to substantially conform to an inner surface of the container. The neck has a first end attached to the body and a second end adapted to conform to a shape of an opening of the container. The valve is adapted for fluid communication between an interior surface and an exterior surface of at least one of the body and neck.

42 Claims, 6 Drawing Sheets

CONTAINER LINERS AND METHODS OF LINING CONTAINERS

CROSS REFERENCE TO RELATED APPLICATION

This application is a non-provisional application of provisional application No. 60/254,385, filed Dec. 8, 2000, the priority of which is claimed herein, and the entire disclosure is incorporated herein by reference.

TECHNICAL FIELD

This invention relates, in general, to storage devices and, in particular, to container liners and methods for lining storage containers.

BACKGROUND ART

Intermediate bulk containers (IBC's or Tote's), an example of which is illustrated in FIG. 1, are used to ship liquids. IBC's generally contain either 275 or 330 gallons of liquids although many other sizes and varieties are available. One example of an IBC is a composite style IBC 1 which is typically a blow-molded bottle 2 manufactured from polyethylene materials, as depicted in FIG. 1.

IBC 1 is housed in a metal cage 4, typically aluminum tubing although steel wire mesh cages are also common. IBC 1 has a six-inch opening 6 in the top center with a discharge opening in the bottom front. A valve 8 is secured to the bottom discharge opening that allows the IBC to be drained by a turn of the valve's handle. As manufacturing technology has improved with this style of container, its use in the bulk liquid shipping market has grown. IBC's are reusable but in many applications cleaning needs to occur between uses.

An industry has developed around the maintenance and cleaning of these IBCs. After use, these containers generally have to be cleaned. This process is not only expensive in many situations, but it takes time and transportation charges to move the bottles to cleaning facilities and then return them to the owners. As an alternative to the cleaning of these containers, there have been several attempts to develop a liner for use with the IBC's which can be disposed of after each use. This eliminates the need to clean the inside of the IBC's, however in practice, these liners have been difficult to install and use. For example, many of such liners resemble "flat bags", which do not conform to the shape of a typical IBC and therefore may create wrinkling of the liner inside the IBC. Such wrinkling may block discharge ports and thus trap liquid contents inside the IBC's.

Therefore, there is a need for an improved liner for bulk storage containers which facilitates discharge of stored materials therefrom and reduces or eliminates cleaning costs for the bulk containers.

SUMMARY OF THE INVENTION

The present invention provides, in a first aspect, a liner system for a container which includes a body, a neck, and a valve. The body is adapted to substantially conform to the inner surface of the container and a first end of the neck is attached to the body and the second end of the neck is adapted to conform to a shape of an opening in the container. The valve is adapted for fluid communication between an interior surface and an exterior surface of at least one of the body and the neck.

The present invention provides, in a second aspect, a liner system for a container which includes a body adapted to sub statically conform to an inner surface of the container and a discharge flange adapted to sealingly engage a discharge valve wherein the discharge valve is detachably connected to the container.

The present invention provides, in a third aspect, a method of lining a container. The method includes providing a liner which has a body adapted to substantially conform to an inner surface of the container and means for providing fluid communication between an inner surface of the liner and an exterior surface of the liner. The method further includes introducing the liner into the interior of the container.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

DETAILED DESCRIPTION

Figure 1:
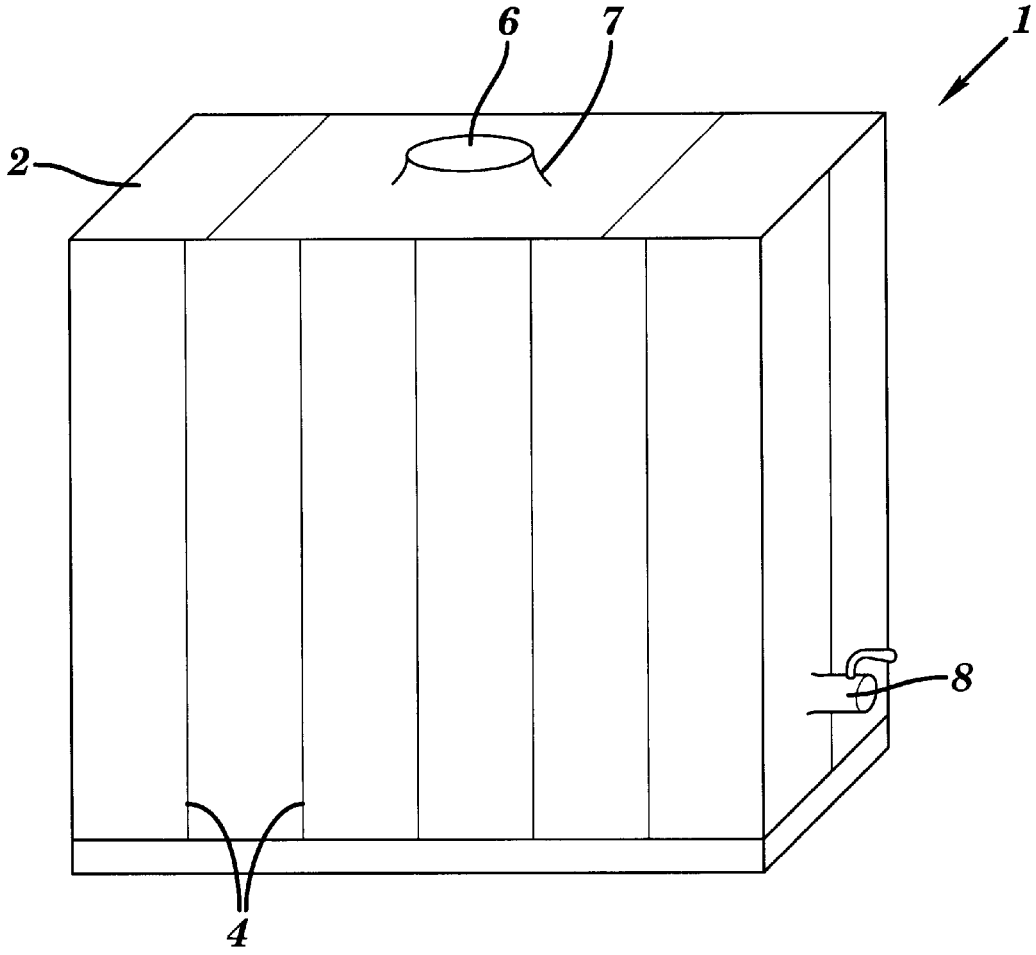
FIG. 1 PRIOR ART
FIG. 1 is a perspective view of an intermediate bulk container.

In accordance with principles of present invention, examples of liner systems and methods for storing materials in liners are depicted in FIGS. 2–8 and described in detail herein.

FIGS. 2–5 depict one embodiment of a liner system 100 for a container which includes a body portion or body 110 adapted to be located in and conform to a shape of an inner surface of a bulk container, for example, IBC 1. A neck 120 is attached to body 110 and an air exit valve 115 is located on neck 120 to allow fluid communication between an inside surface and an outside surface of neck 120.

Body 110 includes a front side (not shown), a rear side 135, a left side 140, a right side 145, a bottom side 150, and a top side 155. The sides may be formed as separate panels and attached to one another, for example, using radio frequency welding. The panels may be made of polyethylene or polyvinyl chloride (PVC) and may be sized to conform to a shape of a container. In one example, the panels are made of 43 inches by 43 inches of 12 mil sheets of PVC assembled together using radio frequency welding. When the panels are attached to one another, they may be somewhat similar to the shape of IBC 1; for example, when inflated body 110 may be substantially cubical.

Figure 2:
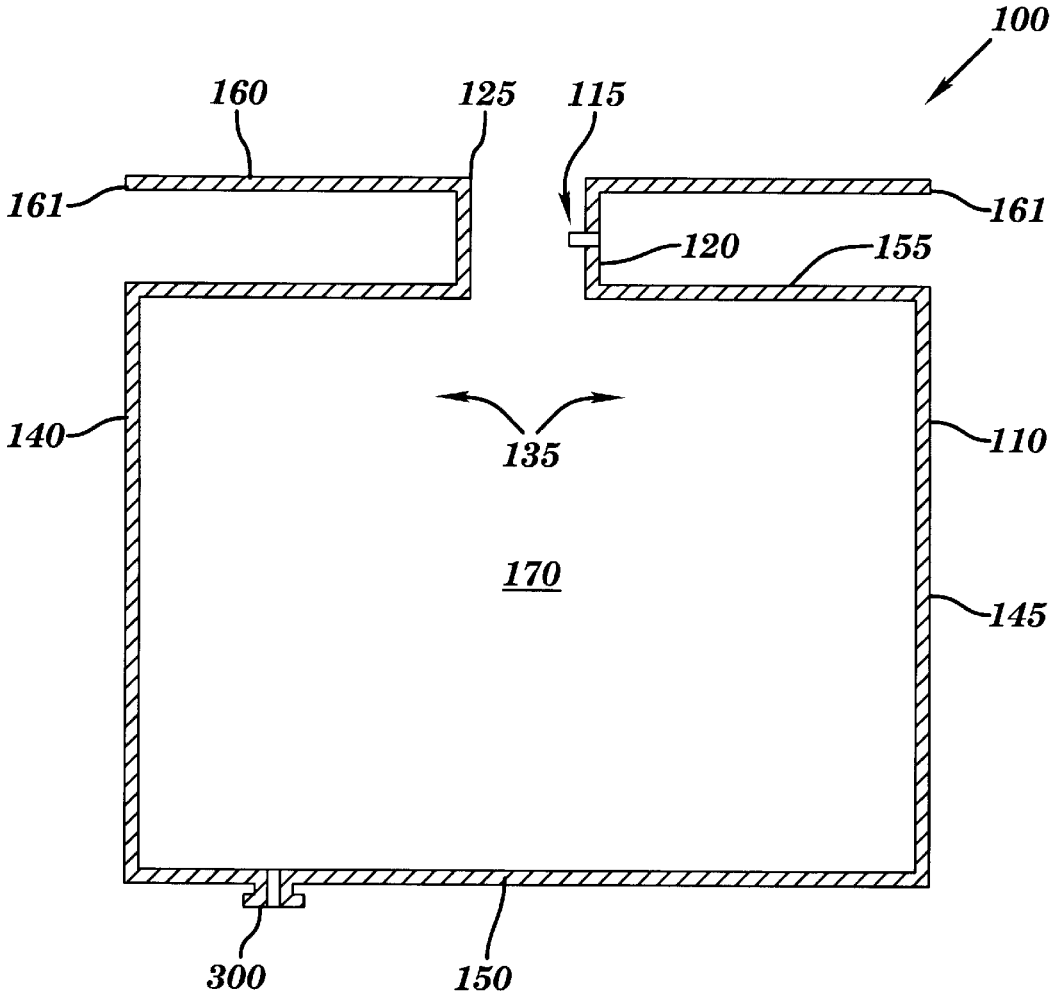
FIG. 2 is side cross-sectional view of a liner adapted for use in the intermediate bulk container of FIG. 1, in accordance with the principles of the present invention.
Figure 3:
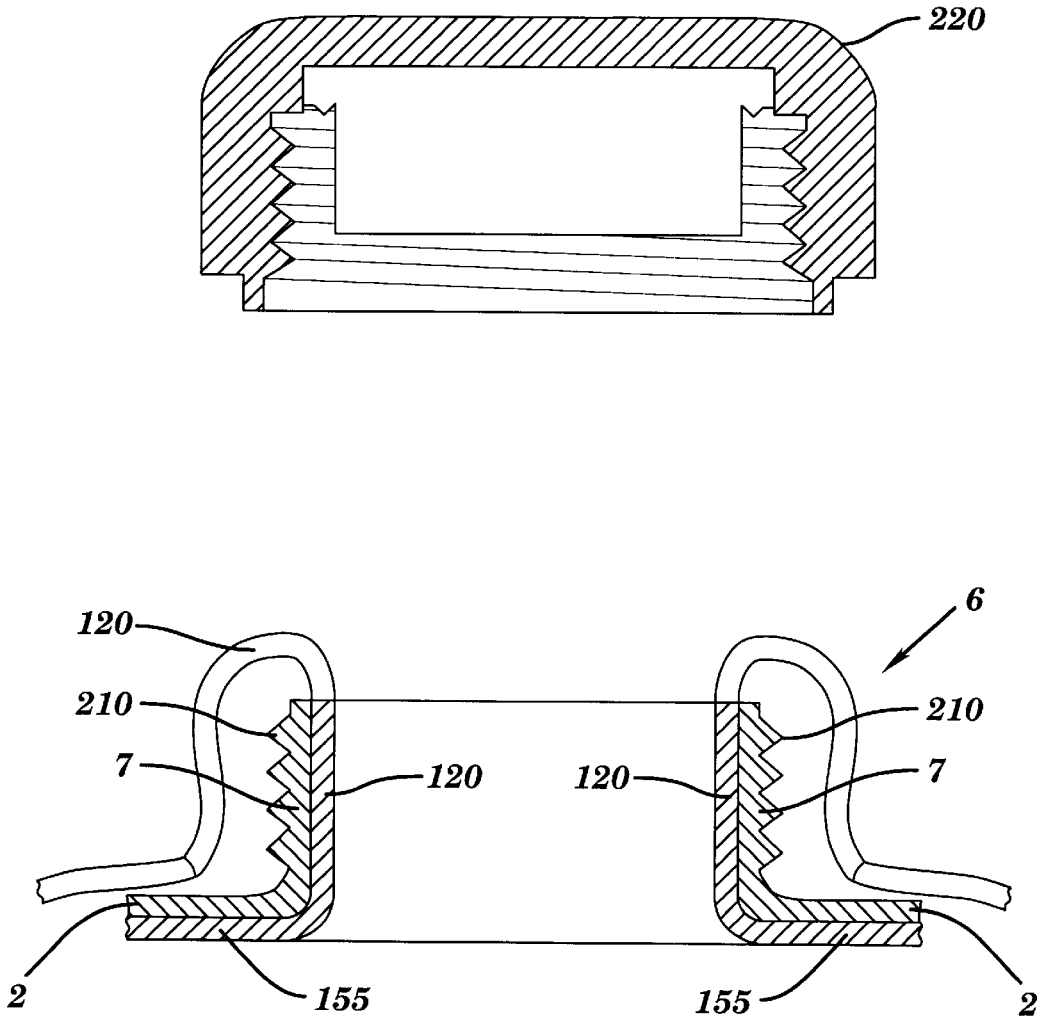
FIG. 3 is an enlarged partial cross-sectional view of the intermediate bulk container of FIG. 1 having the liner of FIG. 2 installed therein and specifically showing the top opening of the intermediate bulk container with the liner protruding therefrom.

Top side 155 of body 110 may be attached to neck 120, for example, by radio frequency welding. Neck 120 is shaped to conform to a top opening 6 and a stem 7 of IBC 1 (FIG. 1), as depicted in FIG. 3. Specifically, neck 120 is adapted to wrap around both an inner and an outer portion of stem 7 which includes a threaded surface 210. A top cap 220 may be screwed onto IBC 1 to engage threaded surface 210 through neck 120, as illustrated in FIG. 3. Cap 220 attached to neck 120 and threaded surface 210 is adapted to allow fluid communication between an interior portion 170 of body 110 and the ambient environment. Neck 120 attached to stem 7 via threaded surface 210 and cap 220 may prevent system 100 from falling down into EBC 1 where it could block discharge valve 8, and prevent contents of IBC 1 from draining. Thus, neck 120 may be narrower in width than body 110, as illustrated in FIG. 2. For example, neck 120 may have a diameter substantially equal to a diameter of an outside surface of stem 7. This allows neck 120 to be folded back around threaded surface 210, and cap 220 to be attached thereto, as described above.

Figure 4:
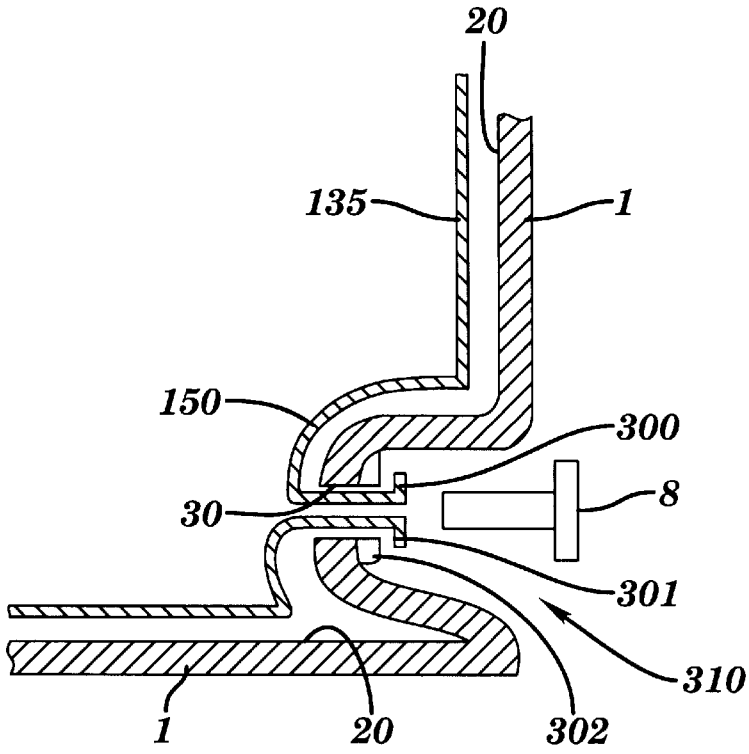
FIG. 4 is another partial cross-sectional view of the intermediate bulk container of FIG. 1 having a liner of FIG. 2 installed therein specifically showing engagement of a discharge flange of the liner and a discharge valve of the intermediate bulk container.

Returning to FIG. 2, neck 120 includes air exit valve 115 which facilitates venting of air from a cavity (not shown) between body 110 and an inner surface 20 (FIG. 4) of IBC 1 during liner installation and/or IBC 1 filling. During installation of system 100 into a container, for example IBC 1, air may be forced into system 100 through discharge valve 8 at the bottom of IBC 1. Pressure of the air causes body 110 to fit or conform to a shape of inner surface 20 (FIG. 4) of IBC 1. To aid in the installation of system 100, when such installation is near completion, neck 120 might be attached to threaded surface 210 via a rubber band or other removable attachment means and air exit valve 115 might be opened. As body 110 is forced against inside surface 20 (FIG. 4) of IBC 1, pockets of air may result between body 110 and inner surface 20 (FIG. 4). Thus, air exit valve 115 may be opened to allow air in these air pockets to be forced to interior portion 170 of body 110 and, thus, out top opening 6 of MBC 1 by force of the air introduced at discharge valve 8.

A bib 160 may be attached to an end 125 of neck 120 and bib 160 may be utilized to cover a top portion of IBC 1 during filling thereof to reduce or eliminate any damage to MBC 1 from material spilling on IBC 1. Bib 160 may be detachably connected to end 125 via perforations 126 (FIG. 8) formed in neck 120 and/or bib 160. Bib 160 may be removed after filling of body 110 inside MBC 1 through detaching along these perforations. Thus, any unsightly or dangerous material spilled on bib 160 may be removed from the top of IBC 1 and any such spilled material might be disposed of through disposal of bib 160. Alternatively, neck 120 might extend from top side 155 of body 110 such that end 125 is located at a top most side of stem 7. This results in an end of bib 160 being located at the top most side of stem 7 and bib 160 being adapted to receive cap 220 such that threaded portions of cap 220 engage threaded surface 210 through neck 120. Thus, neck 160 would have a smaller longitudinal dimension while bib 160 would have a larger surface area as compared to the arrangement illustrated in FIGS. 2–3, for example.

A discharge flange 300 may be located on bottom side 150 of body portion 110, as illustrated in FIGS. 2 and 4. This flange is advantageously located on bottom side 150 due to the configuration of IBC 1 in the vicinity of discharge valve 8. Specifically, IBC 1 has a recessed or somewhat concave portion 310 of inner surface 20 in the vicinity of discharge valve 8, as depicted in FIG. 4. The location of discharge flange 300 on bottom side 150 allows for a desirable fit of body 110 to IBC 1 because recessed portion 310 alters an otherwise cubical nature of inner surface 20 of IBC 1 to cause a discharge opening 30 of IBC 1 to align with bottom side 150. Locating discharge flange 300 on bottom side 150 reduces or eliminates wrinkles in body 110 when liner system 100 is installed in a container having recessed portion 130, for example, IBC 1. This results in more efficient draining of stored material from liner system 100 and IBC 1.

Figure 5:
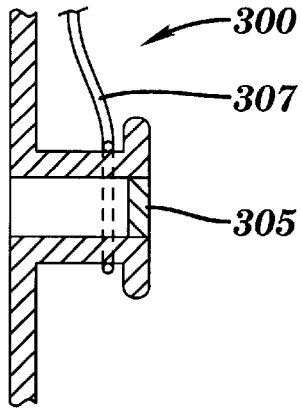
FIG. 5 is a side cross-sectional view of the discharge flange of FIG. 2 having a shape retaining member installed therein.

Prior to installation of liner system 100 in IBC 1, discharge flange 300 may include a shape retaining member 305 to maintain a shape of flange 300 suitable for mounting to discharge valve 8, as illustrated in FIG. 5. For example, shape retaining member 305 may be a cardboard cylinder. A cord 307 may also be attached to discharge flange 300 to allow a user to manipulate and position discharge flange 300 by pulling cord 307 through discharge opening 30 in IBC 1. Discharge flange 300 can thus be positioned to extend out of discharge opening 30 in order to interact with discharge valve 8, as shown in FIG. 4.

Figure 6:
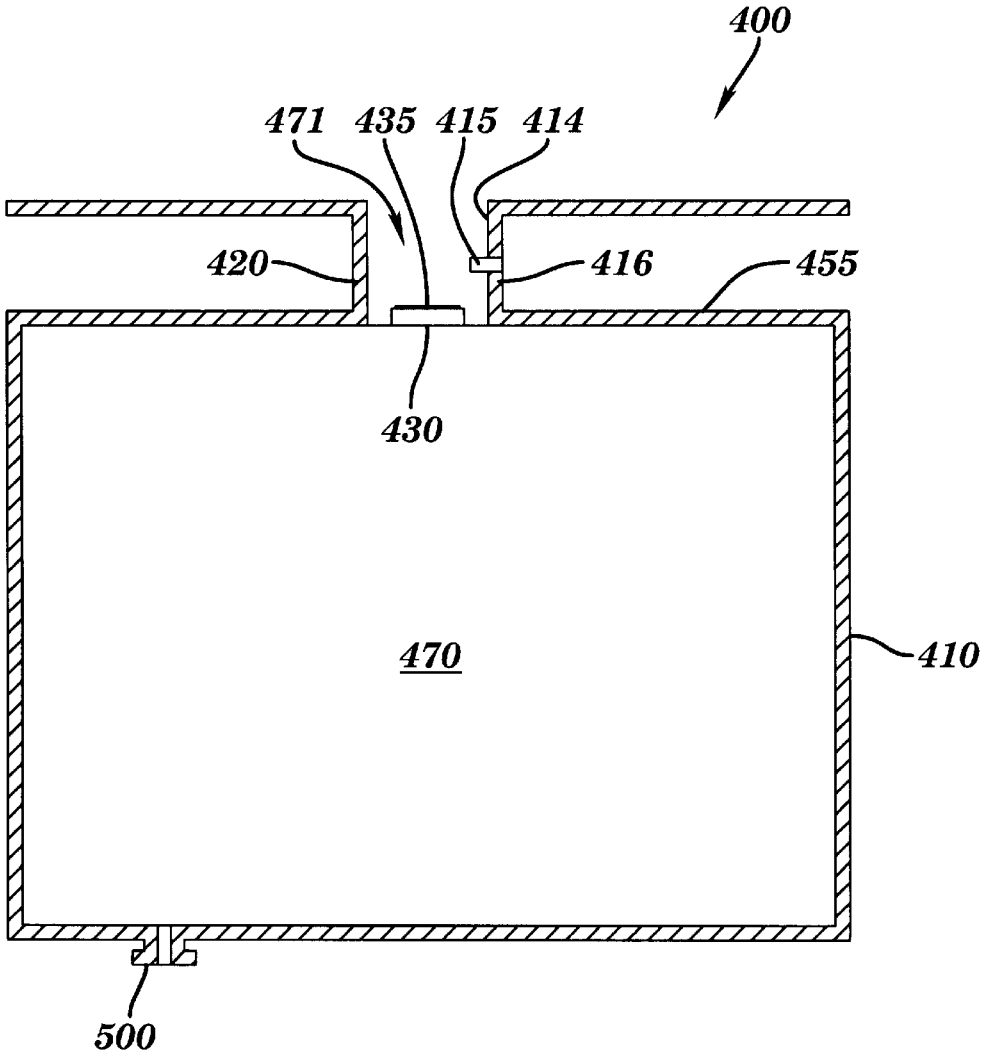
FIG. 6 is a cross-sectional view of another embodiment of a liner for installation in the intermediate bulk container of FIG. 1, in accordance with the present invention.

FIG. 6 illustrates another embodiment of a liner system 400 for a container which includes a body portion or body 410 adapted to be located in and conform to a shape of an inner surface of a container, for example, IBC 1. A neck 420 is attached to a top side 455 of body 410 and an air entry valve 415 is located on neck 420 to allow fluid communication between an inside surface 414 and an outside surface 416 of neck 420.

Figure 7:
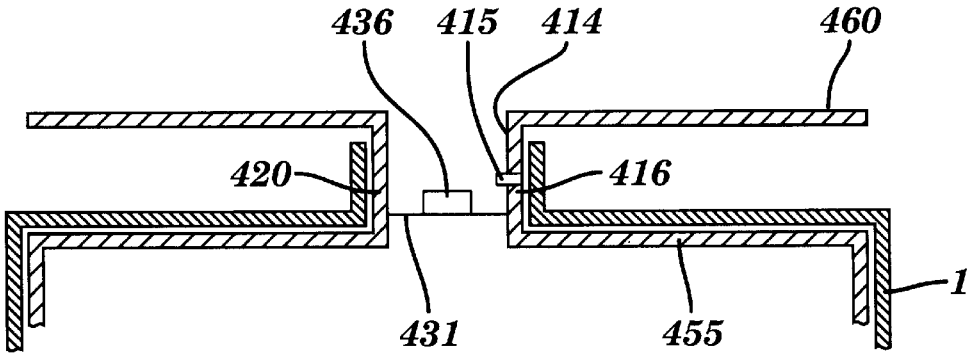
FIG. 7 is a cross-sectional view of a top portion of yet another embodiment of a liner shown installed in the intermediate bulk container of FIG. 1, in accordance with the present invention.
Figure 8:
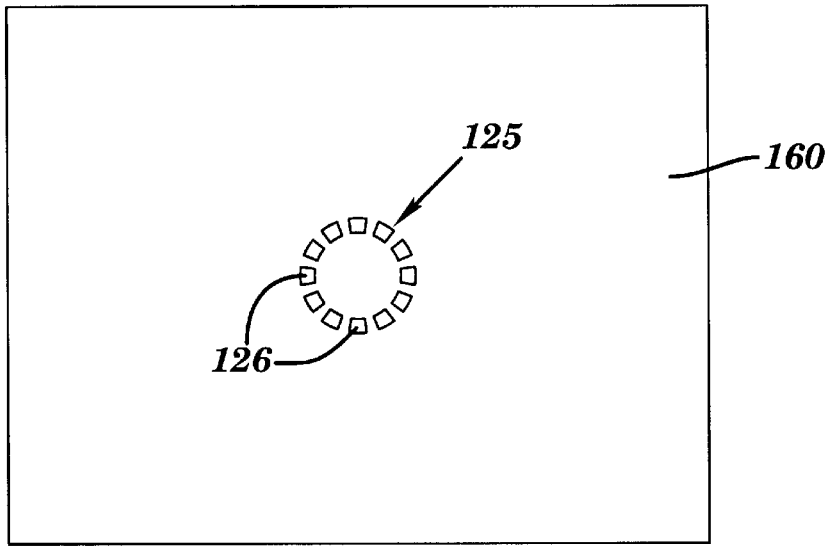
FIG. 8 is a top elevational view of the liner of FIG. 2, specifically showing perforation between a top end of the neck and the bib.

Body 410 includes a top flange 430 attachable to a sealable cap 435 located in an interior space enclosed by neck 420. Cap 435 and top flange 430 thus provide a seal to reduce or eliminate infiltration of ambient air into body 410 through top side 455. Alternatively, a top flange 431 and a sealable cap 436 might be located to provide a seal across a section of neck 420, while still allowing air entry valve 415 to provide fluid communication between inside surface 414 and outside surface 416 of neck 420, as illustrated in FIG. 7.

Returning to FIG. 6, because system 400 is sealable through cap 435, it is useful for containing materials that may be sensitive to air or moisture. In prior art liner systems and containers used without liners, a first liquid is often filled to a certain point and a skimmer liquid is added on top of the first liquid. The skimmer liquid prevents ambient air from contacting the first liquid, as air enters the top of the liner or container to replace liquid exiting out a discharge valve, and potentially curing it prematurely. For example, road paint might utilize a skimmer liquid to prevent ambient air from curing it before it is removed from the liner or container.

Air entry valve 415 reduces or eliminates a need for such a skimmer liquid. After an interior portion 470 of body 410 has been filled with a liquid, cap 435 may be attached and air entry valve 415 may be opened. Air is thus allowed to pass from an interior portion 471 of neck 420 to a cavity (not shown) between body 410 and inner surface 20 of IBC 1. There is no fluid communication between interior portion 470 of body 410 and the ambient air when discharge valve 8 of IBC 1 is closed. Air entry valve 415 may be larger than exit air valve 115 described above for system 100. During discharge of IBC 1, air entry valve 415, when in an opened position, allows air to displace the liquid exiting EBC 1 through a discharge flange 500 and discharge valve 8 by entering though the top of the IBC, passing through air entry valve 415, and filling in the cavity between body portion 410 and inner surface 20 of IBC 1. Liner system 400 thus is allowed to collapse around the liquid as it exits system 400 and IBC 1, and system 400 also contracts or pulls away from inner surface 20. Thus, the liquid contents do not become exposed to the ambient air while in system 400 and EBC 1. Contents vulnerable to air or humidity can therefore be preserved.

An example of a method of installing a liner system of the present invention in a container is now described. Shape retaining member 305 (FIG. 5) is removed from discharge flange 300. Advantageously, system 100 may be fan folded prior to installation thereof such that neck 120 is substantially at one end of system 100 and discharge flange 300 is substantially at another end. Referring to FIGS. 1–2, system 100 is inserted into top opening 6 of EBC 1, preferably such that discharge flange 300 is inserted first and a portion of neck 120 remains outside top opening 6. IBC 1 is tipped forward to cause discharge flange 300 to be located adjacent to discharge opening 30. After discharge valve 8 is removed, the user may reach through discharge opening 30 and grasp cord 307 to pull discharge flange 300 through discharge opening 30, as best illustrated in FIG. 4. A flange portion 301 of discharge flange 300 may be aligned with an outlet portion 302 of discharge opening 30 and discharge valve 8 might be attached to discharge opening 30 to seal discharge flange 300 and discharge valve 8. For example, discharge opening 30 and discharge valve 8 might engage via cooperating threaded portions.

End 125 of neck 120 might be pulled down around stem 7 of opening 6 and attached to stem 7 via a rubber band, elastic band, cord or other means to seal neck 120 to top opening 6 such that a cavity between system 100 and inner surface 20 is isolated. Discharge valve 8 may be opened and air might be introduced therethrough to inflate body 110, for example via a SHOP-VAC type work shop vacuum/blower, leaf blower or other means of introducing air. Air exit valve 115 might be opened to allow air to escape from the cavity (not shown) between body 110 and IBC 1. Alternatively, neck 120 might be sealed around stem 7 after the introduction of air through discharge valve, for example, after a portion of body 110 has conformed to inner surface 20 (FIG. 4).

Air exit valve 115 might be closed after liner system 100 has substantially conformed to inner surface 20 (FIG. 4) of IBC 1. Discharge valve 8 might then be closed and bib 160 might be spread out to cover IBC 1 and liner system 100 might be filled with material for storage. Bib 160 might also include cords (not shown) or other attachment means (not shown) to attach ends 161 of bib 160 opposite neck 160 to IBC 1, for example, corners thereof. Discharge valve 8 might then be opened to discharge contents of IBC 1 when desired by the user.

Another example of a method of installing a liner system in a container is described as follows. Liner system 400 is provided which includes air entry valve 415 in neck 416, sealable cap 435, and top flange 430, as depicted in FIG. 6. Installation of liner system 400 follows the procedure outlined above for system 100 with air entry valve 415 substituting for air exit valve 115 and sealable cap 435 being removed to allow filling of liner system 400 and being reattached to flange 430 after the filling.

However, different from the above described method, discharge of system 400 includes opening air entry valve 416 and discharge valve 8. This allows fluid communication between interior portion 471 of neck 416 and the cavity (not shown) between body 410 and inner surface 20 of IBC 1. Thus, during discharge of stored contents of body 410 through discharge valve 8, air may enter the cavity (not shown) from interior portion 471 of neck 416, which is in fluid communication with the ambient environment. The air replaces a volume inside IBC 1 vacated by contents of body 410 discharged through discharge flange 500 and discharge valve 8. Body 410 thus contracts upon itself away from inner surface 20 of MBC 1. Through this method, the contents of body 410 contacting ambient air can be reduced or eliminated.

Removal of both system 100 and system 400 from IBC 1 may be accomplished in the following manner. Discharge valve 8 is closed and IBC 1 may be tipped on a rear side thereof Discharge valve 8 may be disconnected from IBC 1 and discharge flange 300 or discharge flange 500 may be inserted into IBC 1 through discharge opening 30. The user may reach through top opening 6 and grasp discharge flange 300 or discharge flange 500. System 100 or system 400 may then be removed through a top opening 6 while keeping discharge flange 300 and neck 116 elevated or discharge flange 500 and neck 416 elevated to prevent any remaining contents of system 400 or 100 from being spilled.

Through the utilization of the above described systems and methods, the limitations of the prior art liners and intermediate bulk containers are overcome. For example, the formation of the neck to conform to the shape of the stem of the IBC allows the IBC cap to hold the neck and thus the liner in place. This prevents the liner from falling into the IBC, and thus the risk of the liner blocking the discharge flange is reduced or eliminated. Further, the formation of the liner in a shape substantially similar to the shape of the interior surface of the container also reduces or eliminates wrinkles in the liner. Thus, the risk of the liner blocking the discharge flange and thus preventing material inside the liner from being discharged is reduced or eliminated. Also it is possible to conform the shape of the liner to the container due to the air exit valve which allows air in the cavity between the liner and the interior surface of the IBC to be expelled during installation of the liner. A better fit of the liner to the container is therefore achieved. Also, this better fit allows more efficient use of the liner because air between the liner and the inner surface of the container is less likely to use volume inside the container which might otherwise be used to store desired materials.

Further, materials which are sensitive to ambient elements are served by the above described system and method since these materials have reduced exposure to the ambient elements through the use of a liner cap and an air entry valve. The liner cap prevents a route of exposure between the ambient elements and the contents of the liner, while the air entry valve allows air to flow to a cavity between the liner and the interior surface of the container while the liner is being discharged. Thus the volume vacated by the exiting materials may be replaced by air entering the cavity through the air entry valve. Furthermore, use of a liner in an IBC through the methods systems described above reduces or eliminates the need to have the interior of the IBC cleaned after each use.

It will be understood to one skilled in the art that system 100 may be adapted for use in containers of various shapes or sizes. For example, body portion 110 might be formed in a cylindrical shape for a cylindrical container. Neck 120 might be formed in a square shape to fit a square opening in a container. Similarly, system 400 may be adapted for use in various containers. System 100 and system 400 may also be utilized to store various materials including various liquids, solids and gases.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A liner system for a container, said system comprising:

a body adapted to substantially conform to an inner surface of the container;

a neck having a first end attached to the body and a second end adapted to conform to a shape of an opening of the container; and a valve adapted for fluid communication between an interior surface and an exterior surface of said neck wherein said valve is located on said neck.

2. The system of claim 1 further comprising a cavity between the inner surface of the container and an exterior surface of at least one of said body and said neck, when said body is located in said container, and wherein said valve comprises an air exit valve adapted to allow air to flow from said cavity to at least one of an interior portion of said body and an interior portion of said neck during introduction of air into at least one of said body and said neck.

3. The system of claim 1 further comprising a cavity between the inner surface of the container and an exterior surface of at least one of said body and said neck, when said body is located in said container, and wherein said valve comprises an air entrance valve adapted to allow air to enter said cavity during discharge of stored materials from said body.

4. The system of claim 3 wherein said neck further comprises a top flange and a liner cap attachable to said top flange for sealing an interior portion of said body and at least a portion of said neck from an ambient environment.

5. The system of claim 3 wherein said body further comprises a top flange and a liner cap attachable to said top flange for sealing said body from an ambient environment.

6. The system of claim 5 wherein said liner cap, when it is attached to said top flange, is located in an interior portion of said neck.

7. The system of claim 6 wherein said valve is adapted to allow air to flow between an inner portion of said neck and said cavity.

8. The system of claim 5 wherein said body is adapted to contract from an inner surface of the container during a discharge of contents of said body.

9. The system of claim 1 further comprising a bib attached to said neck for covering a top portion of the container.

10. The system of claim 9 wherein said bib and said neck comprise a perforated surface therebetween adapted to allow removal of said bib from said neck.

11. The system of clam 1 wherein said body comprises a plurality of panels attached to one another.

12. The system of claim 11 wherein said plurality of panels is attached to one another by a radio frequency welding process.

13. The system of claim 1 wherein at least one of said body and said neck comprise at least one of polyvinyl chloride and polyethylene.

14. A liner system for a container, said system comprising a body adapted to substantially conform to an inner surface of the container;

a neck having a first end attached to the body and a second end adapted to conform to a shape of an opening of the container;

a valve adapted for fluid communication between an interior surface and an exterior surface of at least one of said body and said neck;

wherein said body comprises a plurality of panels attached to one another and further comprises a discharge flange attached to a bottom panel of said plurality of panels.

15. The system of claim 14 wherein said discharge flange is attached to said bottom panel by a radio frequency welding process.

16. The system of claim 14 wherein said discharge flange comprises a cylindrical portion attached to said body and a flange portion about perpendicular to said cylindrical portion, and said flange portion is adapted to provide a seal between said discharge flange and a discharge valve of the container.

17. The system of claim 14 wherein said discharge flange is adapted to matingly engage with a discharge valve of the container.

18. The system of claim 17 wherein said discharge valve is located in a recessed portion of the container.

19. The system of claim 14 further comprising a shape retaining member adapted to retain a shape of said discharge flange prior to installation of the system.

20. The system of claim 14 further comprising a cord attached to said discharge flange to allow said discharge flange to be manipulated by a user.

21. A liner system for a container, said system comprising a body adapted to substantially conform to an inner surface of the container, said body having an interior portion for holding materials; and a discharge flange adapted to sealingly engage a discharge valve wherein said discharge valve is detachably connected to the container; and wherein the discharge valve is selectively operable to allow discharge of the materials from said interior portion when the discharge valve is engaged to said discharge flange and connected to the container.

22. The system of claim 21 further comprising means for fluid communication between an interior surface of said body and a cavity located between an outer surface of said body and said inner surface of the container.

23. The system of claim 22 further comprising a neck attached to said body wherein said means is located on said neck.

24. The system of claim 23 further comprising means for sealing said body from an ambient environment.

25. A method of lining a container, said method comprising:

providing a liner wherein said liner comprises:

a body adapted to substantially conform to an inner surface of the container;

means for providing fluid communication between an inner surface of the liner and an exterior surface of the liner;

introducing the liner into an interior of the container; and introducing air into the interior of the container to force air to an interior of the liner from a cavity between the inner surface of the container and the exterior surface of the liner through the means for providing fluid communication.

26. The method of claim 25 wherein the body further comprises a discharge flange and a cord detachably connected to the discharge flange and wherein the method further comprises rotating a top of the container to cause the cord to move toward a discharge opening of the container.

27. The method of claim 26 further comprising drawing the discharge flange through the discharge opening and attaching a discharge valve to the container at the discharge opening to seal the discharge valve with the discharge flange.

28. The method of claim 25 wherein the liner further comprises a neck attached to the body and the container further comprises a top opening having a stem and wherein the method further comprises locating an end of the neck over the stem.

29. The method of claim 28 wherein the top opening further comprises a cap and the method further comprises attaching the cap to the end of the neck located over the stem.

30. The method of claim 25 wherein the introducing air comprises introducing air into the interior of the liner through a discharge valve of the container and a discharge flange of the liner.

31. The method of claim 25 wherein the means for providing fluid communication comprises an air valve and the method further comprises opening the air valve to cause air to pass from the cavity to the interior of the liner.

32. The method of claim 31 further comprising closing the air valve.

33. The method of claim 25 further comprising filling the liner with a material through a top opening of the container.

34. The method of claim 25 wherein the liner further comprises a neck and a bib connected to an end of the neck and the method further comprises detaching the bib from the neck.

35. The method of claim 25 wherein the liner further comprises a top flange and a liner cap and the method further comprises detachably connecting the liner cap to the flange to cause the liner cap to be sealed with the liner.

36. The method of claim 35 further comprising opening the air valve.

37. The method of claim 36 further comprising discharging material from the discharge vale to cause air to enter the cavity through the air valve.

38. A liner system for a container, said system comprising:

a body adapted to substantially conform to an inner surface of the container;

a neck having a first end attached to said body and a second end adapted to conform to a shape of an opening of the container;

at least one of said body and said neck forming a cavity between an inner surface of the container and an exterior surface of said at least one of said body and said neck; and a valve for directing fluid communication between said cavity and an interior portion of said at least one of said body and said neck.

39. The liner system of claim 38 wherein said valve is located on said at least one of said body and said neck.

40. A liner-container system comprising a container having an input opening and the liner system of claim 38.

41. A liner system for a container, said system comprising:

a body adapted to substantially conform to an inner surface of the container;

a neck having a first end attached to the body and a second end adapted to conform to a shape of an opening of the container; and a bib attached to said neck for covering a top portion of the container.

42. The system of claim 41 wherein said bib and said neck comprise perforations therebetween for allowing removal of said bib from said neck.

* * * * *

UNITED STATES PATENT AND TRADEMARK OFFICE

CERTIFICATE OF CORRECTION

PATENT NO. : 6,505,657 B1
DATED : January 14, 2003
INVENTOR(S) : Lawrence

It is certified that error appears in the above-identified patent and that said Letters Patent is hereby corrected as shown below:

Column 8,
Line 42, delete the word "operable" and insert -- openable --

Signed and Sealed this

Thirteenth Day of May, 2003

JAMES E. ROGAN
*Director of the United States Patent and Trademark Office*